US012377304B2

(12) United States Patent
Tong

(10) Patent No.: US 12,377,304 B2
(45) Date of Patent: Aug. 5, 2025

(54) ADJUSTABLE WEIGHT DUMBBELLS

(71) Applicant: Xiaorong Tong, Jinhua (CN)

(72) Inventor: Xiaorong Tong, Jinhua (CN)

( * ) Notice: Subject to any disclaimer, the term of this patent is extended or adjusted under 35 U.S.C. 154(b) by 308 days.

(21) Appl. No.: 18/172,792

(22) Filed: Feb. 22, 2023

(65) Prior Publication Data

US 2023/0271050 A1 Aug. 31, 2023

(30) Foreign Application Priority Data

Feb. 27, 2022 (CN) ..... 202210182814.6

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/0728; A63B 21/075
See application file for complete search history.

(56) References Cited

U.S. PATENT DOCUMENTS

2020/0398100 A1* 12/2020 Wang ..... A63B 21/0726

FOREIGN PATENT DOCUMENTS

CN 106730590 A * 5/2017
CN 110327584 A * 10/2019
WO WO-2008071029 A1 * 6/2008 ..... A63B 21/063

* cited by examiner

*Primary Examiner* — Megan Anderson
(74) *Attorney, Agent, or Firm* — Sandy Lipkin

(57) ABSTRACT

An adjustable weight dumbbell includes a dumbbell bar, a handle, a dial, a dumbbell rack assembly, weight adjustment assemblies, and weight plates. The dumbbell rack assembly includes inner and outer support frames and a connecting frame fixed with the support frames. The inner support frame is rotatably cooperated with the handle, the outer support frame and the dumbbell bar. The inner support frame includes a locking mechanism for locking a rotation of the inner support frame relative to the dial. The weight adjustment assemblies connected on the connecting frame include a weight adjustment housing, a cam rotatably disposed in the housing, and a weight connecting assembly. The cam is sleeved on the dumbbell bar and includes protruding teeth arranged in sequence according to the weight. The weight connecting assembly is cooperated with the protruding teeth, and is driven by the protruding teeth to connect with the corresponding weight plate.

10 Claims, 13 Drawing Sheets

ADJUSTABLE WEIGHT DUMBBELLS

FIELD OF THE INVENTION

The invention relates to the technical field of sports fitness equipment, in particular, to an adjustable weight dumbbell that adjusts a weight of a dumbbell by rotating a handle.

BACKGROUND OF THE INVENTION

Along with the raising of living standard, people pay more and more attention to bodybuilding and body shape, and dumbbells are very popular as the most commonly used fitness equipment for bodybuilding and body shape training. Traditional dumbbells are formed in one piece, so the weight cannot be changed. In order to adapt to the training requirements of different stages, a plurality of dumbbells with different weights must be purchased, which has the problems of high purchase cost and unfavorable storage. Existing dumbbells include a dumbbell bar and a plurality of weight plates sleeved at both ends of the dumbbell bar; the weight plates need to be assembled to the main shaft one by one to adjust the weight of the weight, which is not convenient for weight adjustment; the weight of the dumbbell needs to be obtained by calculating the weight of the weight plate one by one, but cannot be obtained intuitively, so that the user experience is poor.

In order to facilitate the weight adjustment of the dumbbell and obtain the weight of the weight directly, Chinese patent authorization announcement number CN100337706C discloses an adjustable dumbbell device. When in use, an adjustable dumbbell is put into a support base, and the selector knobs on the left and right sides of the dumbbell are turned respectively, so that the weight plates with required weight are combined with the dumbbell while keeping the unneeded weight plates on the support base. If the user needs to adjust the weight of the dumbbell, the dumbbell can be put back into the support base, and the selector knobs on the left and right sides can be turned again, so that the weight plates with desired weight can be combined with the dumbbell. The structure also has the following problems during use: one is that the weight adjustment on the left and right sides of the dumbbell cannot be carried out synchronously, and is implemented step by step instead, i.e., first adjusting the weight on one side and then adjusting the weight on the other side, the weight adjustment being further improved; the other is that although there are scale indicators when the left and right weights of the dumbbells are adjusted, there will still be low-level mistakes that the left and right weights are inconsistent due to inattention. For this reason, many manufacturers and people of insight carry out development and research, but there is not yet relatively desirable product to come out so far.

BRIEF SUMMARY OF THE DISCLOSURE

In order to overcome the above problems in the prior art, an objective of the invention is to provide an adjustable weight dumbbell with simple operation, multiple adjustment gears, convenient weight adjustment and direct reading of weight.

The technical solution adopted by the invention to solve the above technical problems includes a dumbbell bar, a handle disposed on the dumbbell bar, a dial fixedly connected on both sides of the handle, a dumbbell rack assembly disposed rotatably on both sides of the dumbbell bar, a plurality of weight adjustment assemblies, and weight plates cooperated with the weight adjustment assemblies. The dumbbell rack assembly includes an inner support frame, an outer support frame, and a connecting frame fixedly connected with the inner and outer support frames. The inner support frame is rotatably cooperated with the handle, the outer support frame is rotatably cooperated with the dumbbell bar, and the inner support frame is provided with a locking mechanism for locking a rotation of the inner support frame relative to the dial. The plurality of weight adjustment assemblies is correspondingly connected on the connecting frame. The weight adjustment assemblies include a weight adjustment housing, a cam rotatably disposed in the weight adjustment housing, and a weight connecting assembly. The cam is sleeved on the dumbbell bar, and is provided with protruding teeth arranged in sequence according to the weight. The weight connecting assembly is cooperated with the protruding teeth and is driven by the protruding teeth to connect with the corresponding weight plate.

As a further solution of the invention, the weight connecting assembly includes a pushing member that may slide longitudinally relative to the weight adjustment housing and be cooperated with the protruding teeth, and a sliding member that may slide laterally relative to the weight adjustment housing and may be elastically reset; the sliding member is provided with column pins connected with the weight plates, and the cams on the plurality of weight adjustment assemblies are engaged with each other and then engaged with the handle; when the handle is turned to drive the cams on the plurality of weight adjustment assemblies to rotate, the protruding teeth on different cams press the pushing member, and the pushing member pushes the sliding member, so that the column pins on the sliding member are connected with different weight plates to adjust the weight.

As a further solution of the invention, the dial is provided with gear scales that are evenly distributed for indicating the weight, and positions of the protruding teeth provided by the cams on the plurality of weight adjustment assemblies are consistent with the gear scales.

As a further solution of the invention, the weight adjustment housing includes a weight seat and a weight cover fixed on the weight seat, rotation positioning sleeves are correspondingly disposed on the weight seat and the weight cover, both sides of the cam are provided with sleeves, and the sleeves are rotatably cooperated with the rotation positioning sleeves on the weight seat and the weight cover.

As a further solution of the invention, the connecting frame is provided with a sliding rail, the weight seat is provided with a sliding groove, the weight seat is mounted on the connecting frame through the cooperation of the sliding groove and the sliding rail, and the connecting frame is provided with a decorative upper cover.

As a further solution of the invention, the pushing member is provided with a guiding groove, and a guiding pin passing through the guiding groove is disposed between the weight seat and the weight cover.

As a further solution of the invention, the weight plate is provided with an open groove, a lower portion of the open groove is provided with a concave inserting groove, and both sides of the concave inserting groove are provided with cover plates; a lower portion of the weight adjustment assembly is provided with an inserting portion cooperated with the concave inserting groove, both sides of the cam are disposed on a semicircular groove of the corresponding cover plate, and the cover plate on one side or both sides is provided with weight plate connecting holes cooperated with the column pins.

As a further solution of the invention, the locking mechanism includes a spring, and a locking block; the locking block is provided with a locking block guiding groove, and the dial is provided with rotation locking sheets that are evenly distributed around a circumference and correspond to the gear scales; an inner side of the inner support frame is provided with an assembly groove, and the assembly groove is provided with a rotation guiding groove for the rotation locking sheets to pass through when the dial rotates; the spring and the locking block are mounted on the assembly groove correspondingly; when the locking block is lifted upwards, the locking block guiding groove coincides with the rotation guiding groove, and the rotation locking sheets may pass through smoothly; when the locking block is unclamped, the locking block guiding groove and the rotation guiding groove are dislocated from each other, and the locking block blocks the rotation locking sheets to prevent the dial from rotating.

As a further solution of the invention, the dial is provided with recesses that are evenly distributed around the circumference and correspond to the gear scales, the inner support frame is fixed with a positioning bracket, and the positioning bracket is provided with elastic positioning members cooperated with the positioning recesses.

As a further solution of the invention, the dumbbell further includes a dumbbell seat, the dumbbell seat is provided with a jacking block, and the locking mechanism releases the locking of the dial when the jacking block is cooperated with the locking block; the dumbbell seat is correspondingly provided with an inner support frame positioning groove for positioning and placing the inner support frame, and a weight plate positioning groove for positioning and placing the weight plates.

With the above structure, the invention has the following advantages and effects as compared with the prior art: first, when the weight is adjusted, the dial and all the cams rotate with the handle and the dumbbell bar, and the protruding teeth on the cam drive the weight adjustment assembly to connect with the corresponding weight plates, so that the weight of the weight adjustment assembly connected to the weight plates is consistent with the gear scale on the dial, and the weight of the dumbbell may be read directly from the dial; second, through the reasonable arrangement of the positions of the protruding teeth on different cams, the dumbbell may be combined with more gears to form different weights; third, when the weight is adjusted, the handle may be operated forward or reversed to hang weight plates of different weights, so that the weight adjustment is simple and convenient, and the controllability is good.

Figure 1:
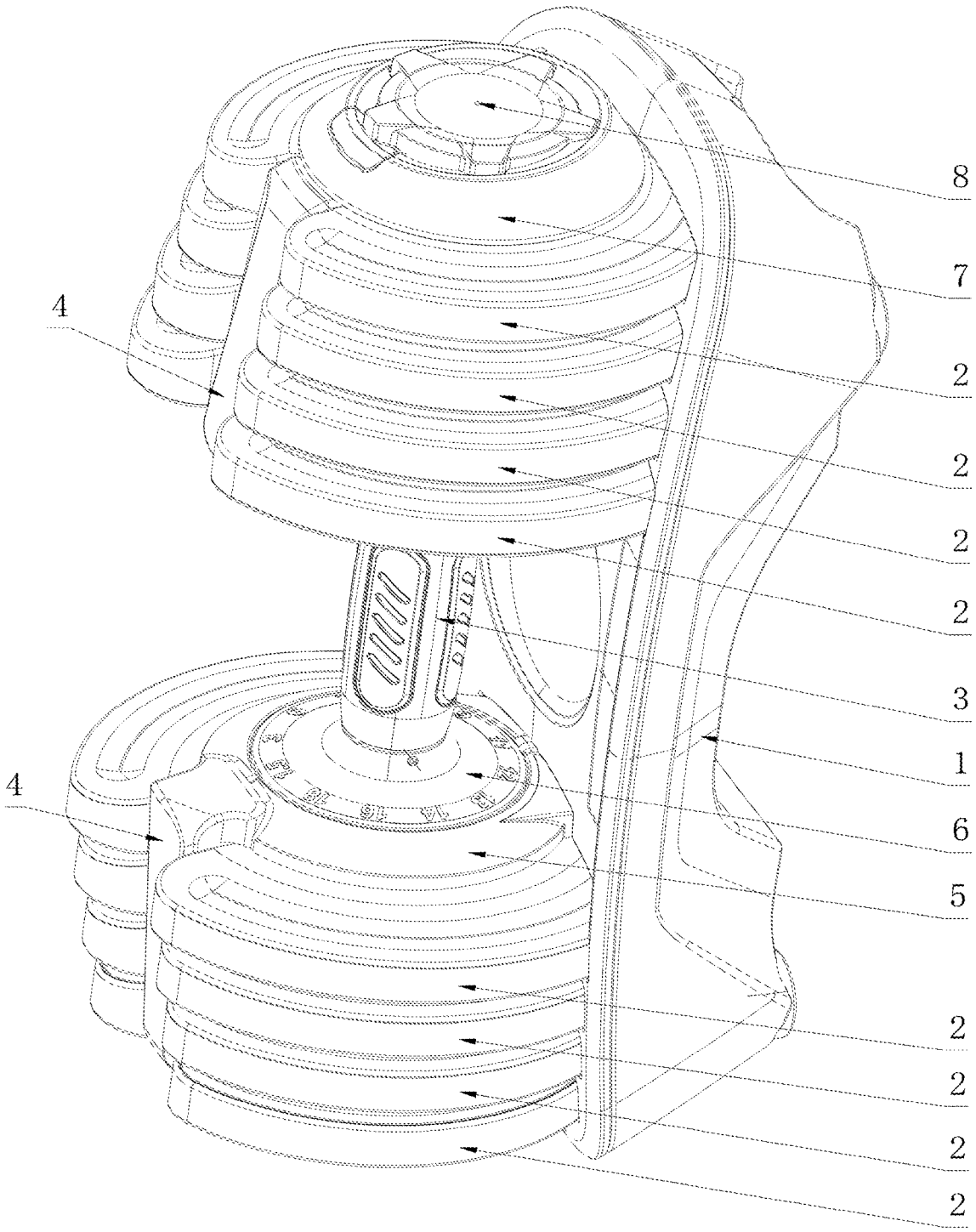
FIG. 1 is a three-dimensional diagram according to the invention.

In figures: 1—Dumbbell seat; 2—Weight plate; 3—Handle; 4—Dumbbell rack assembly; 5—Inner support frame; 6—Dial; 7—Outer support frame; 8—Decorative end cover; 9—Wight adjustment assembly; 10—Weight plate connecting hole; 11—Jacking block; 12—Inner support frame positioning groove; 13—Wight plate positioning groove; 14—Locking mechanism; 15—Compression block sheet; 16—Decorative upper cover; 17—Connecting frame; 18—Weight cover; 19—Weight seat; 20—Dumbbell bar; 21—Cam; 22—Pushing member; 23—Sliding member; 24—Reset spring; 25—Locking block; 26—Spring; 27—First cam; 28—Second cam; 29—Third cam; 30—Fourth cam; 31—Sliding groove; 32—Sliding rail; 33—Rotation positioning sleeve; 34—Inserting key; 35—Protruding teeth; 36—Sleeve; 37—Inserting port; 38—Column pin; 39—Guiding pin; 40—Column pin hole; 41—Open groove; 42—Cover plate; 43—Convex inserting groove; 44—Inserting portion; 45—Handle inserting groove; 46—Positioning bracket; 47—Elastic positioning member; 48—Gland; 49—Gland inserting key; 50—Assembly groove; 51—Rotation guiding groove; 52—Jacking block guiding groove; 53—Locking block guiding groove; 54—Rotation locking sheet; 55—Positioning recess; 56—Gland inserting port; 60—Weight connecting assembly.

DETAILED DESCRIPTION OF THE INVENTION

As shown in FIGS. 1 to 15, a specific embodiment of an adjustable weight dumbbell is shown. The adjustable weight dumbbell includes a dumbbell bar 20, a handle 3 disposed on the dumbbell bar 20, a dial 6 fixedly connected on both sides of the handle 3, a dumbbell rack assembly 4 rotatably disposed on both sides of the dumbbell bar, a plurality of weight adjustment assemblies 9, and weight plates 2 cooperated with the weight adjustment assemblies 9, wherein the handle 3 is sleeved on the dumbbell bar 20 and is fixed by pins; the dumbbell rack assembly 4 includes an inner support frame 5, an outer support frame 7, and a connecting frame 17 fixedly connected with the inner support frame 5 and the outer support frame 7, the inner support frame 5 being rotatably cooperated with the handle 3, the outer support frame 7 being rotatably cooperated with the dumbbell bar 20; an end surface of the dumbbell bar 20 is fixed with a compression block sheet 15 that compresses the outer support frame 7 and may be rotated relative to the outer support frame 7, and the outer support frame 7 is fixed with a decorative end cover 8 for shielding center holes; the inner support frame 5 is provided with a locking mechanism 14 for locking a rotation of the inner support frame 5 relative to the dial 6, which may ensure that the weight plates 2 are reliably connected with the weight adjustment assembly 9 during training. An end surface of the handle 3 is fixedly with a gland 48 for positioning the inner support frame 5, the handle 3 is provided with a handle inserting groove 45, the gland 48 is provided with a gland inserting key 49 that cooperates with the handle inserting groove 45 to facilitate assembly and positioning, and the other side of the gland 48 is provided with a gland inserting port 56.

Figure 4:
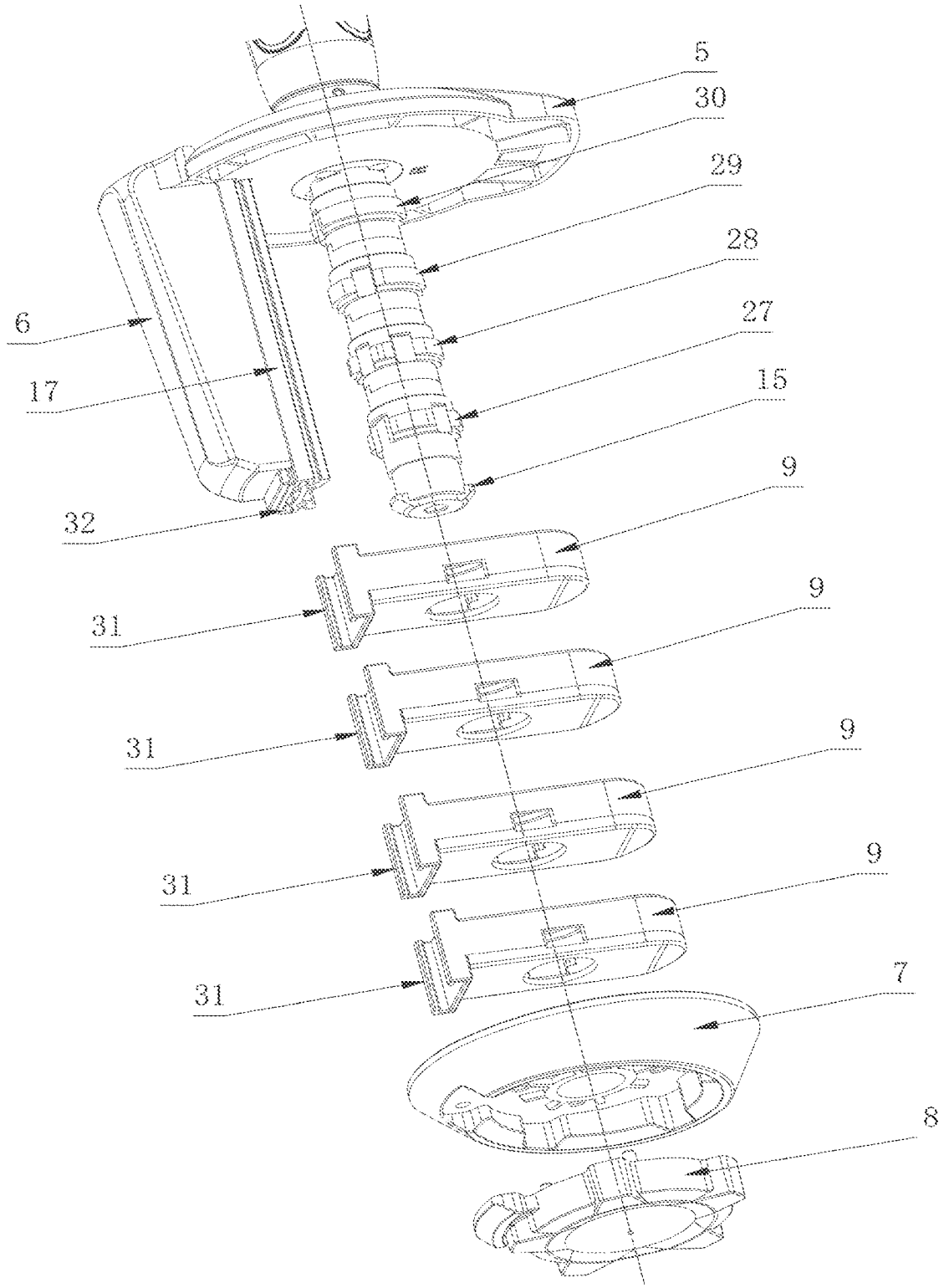
FIG. 4 is an exploded diagram of a dumbbell rack on one side according to the invention.
Figure 5:
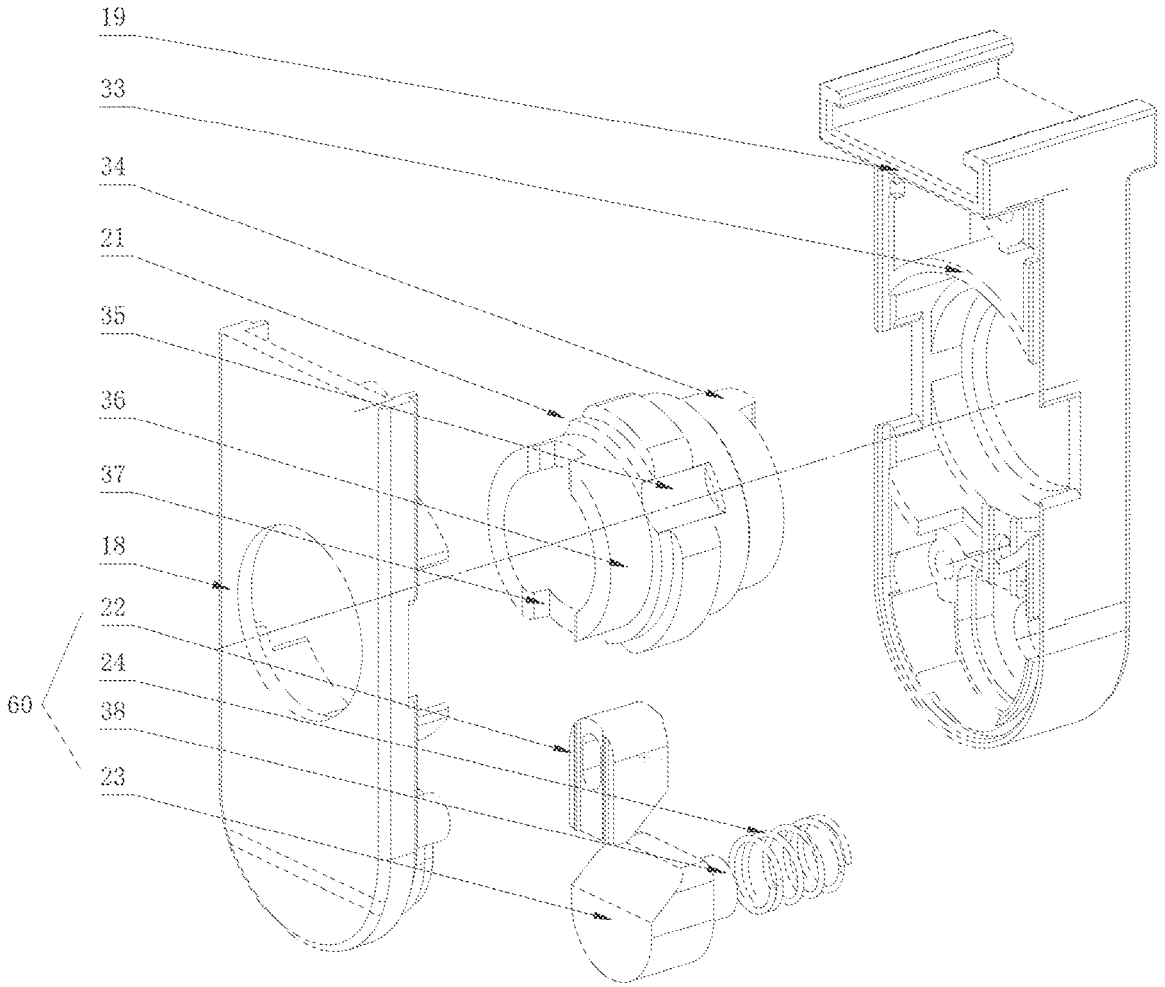
FIG. 5 is an exploded diagram of a weight adjustment assembly according to the invention.
Figure 6:
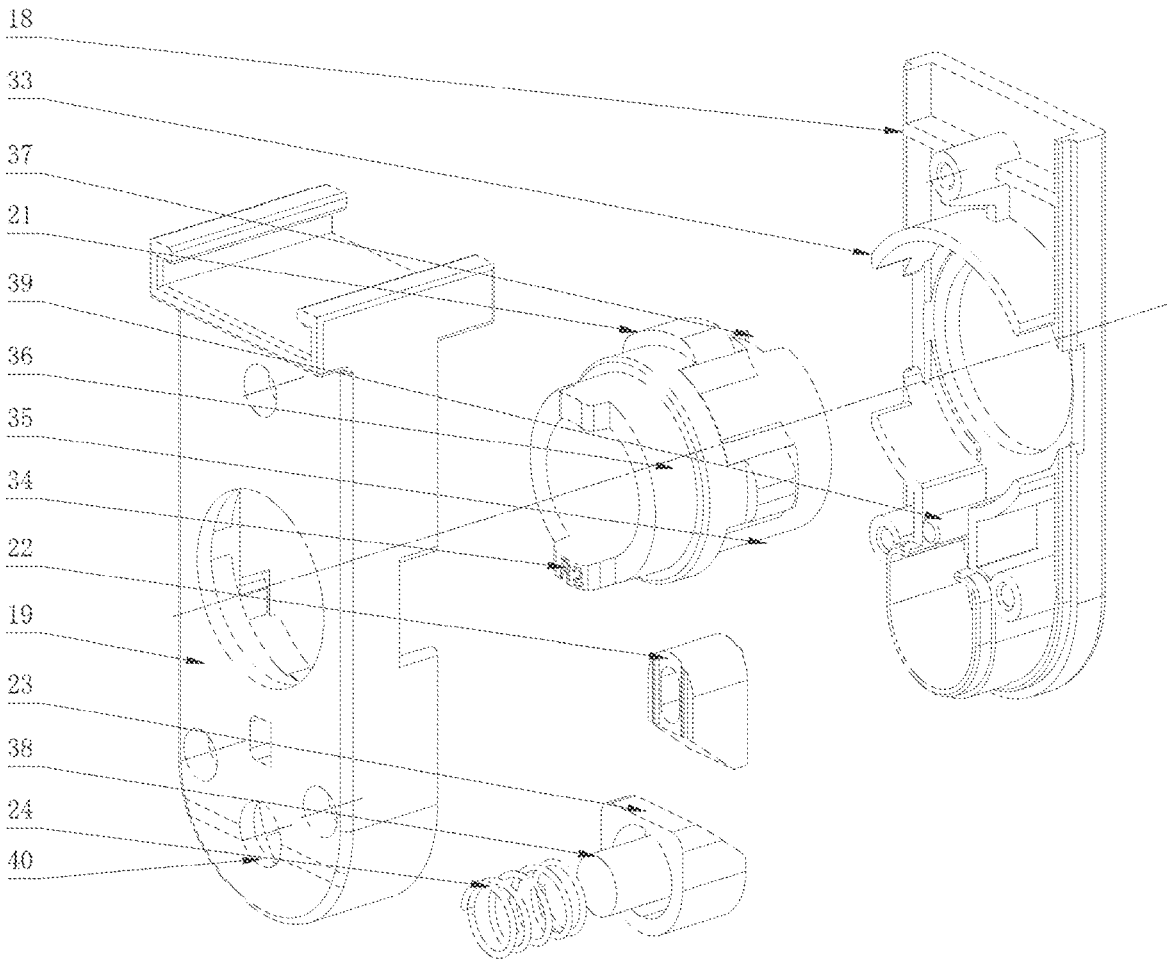
FIG. 6 is an exploded diagram of another direction of the weight adjustment assembly according to the invention.

As shown in FIGS. 4, 5 and 6, the plurality of weight adjustment assemblies 9 are correspondingly connected on the connecting frame 17, and the weight adjustment assemblies 9 include a weight adjustment housing, a rotatable cam 21 disposed in the weight adjustment housing, and a weight connecting assembly 60, the cam 21 being sleeved on the dumbbell bar 20 and provided with protruding teeth 35 arranged in sequence according to the weight, the weight connecting assembly 60 being cooperated with the protruding teeth 35 and driven by the protruding teeth 35 to connect with the corresponding weight plate 2.

As shown in FIGS. 5, 6, 8 and 9, the weigh connecting assembly 60 includes a pushing member 22 that may slide longitudinally relative to a weight adjustment housing and be cooperated with the protruding teeth 35, and a sliding member 23 that may slide laterally relative to the weight adjustment housing and may be elastically reset through a reset spring 24; the pushing member 22 is slidably cooperated with the sliding member 23, the sliding member 23 is provided with column pins 38 connected with the weight plates 2, and inserting keys 34 and inserting ports 37 that are inserted with each other are disposed on the cam 21 correspondingly; the cams 21 on the plurality of weight adjustment assemblies 9 are engaged with each other through the inserting keys 34 and the inserting ports 37, and then the cams 21 inside are engaged with the gland inserting port of the gland 48 fixed on the handle 3 through the inserting keys 34; when the handle 3 is rotated to adjust the weight, the handle 3 drives the cams 21 on the plurality of weight adjustment assemblies 9 to rotate, the protruding teeth 35 on different cams 21 press the pushing member 22, and the pushing member 22 pushes the sliding member 23, so that the column pins 38 on the sliding member 23 move horizontally, and the column pins 38 extend out of column pin holes 40 on the weight adjustment housing to insert into the weight plate connecting hole 10 of the corresponding weight plate 2 for adjusting the weight.

As shown in FIGS. 1, 2, 12 to 15, the dial 6 is provided with gear scales that are evenly distributed for indicating the weight, and positions of the protruding teeth 35 provided by the cams 21 on the plurality of weight adjustment assemblies 9 are consistent with the gear scales.

As shown in FIGS. 5 and 6, the weight adjustment housing includes a weight seat 19 and a weight cover 18 fixed on the weight seat 19, rotation positioning sleeves 33 are correspondingly disposed on the weight seat 19 and the weight cover 18, both sides of the cam 21 are provided with sleeves 36, and the sleeves 36 are rotatably cooperated with the rotation positioning sleeves 33 on the weight seat 19 and the weight cover 18. The pushing member 22 is provided with a guiding groove, and a guiding pin 39 passing through the guiding groove is disposed between the weight seat 19 and the weight cover 18.

As shown in FIG. 4, the connecting frame 17 is provided with a sliding rail 32, the weight seat 19 is provided with a sliding groove 31, the weight seat 19 is mounted on the connecting frame 17 through the cooperation of the sliding groove 31 and the sliding rail 32, and the connecting frame 17 is provided with a decorative upper cover 16.

Figure 7:
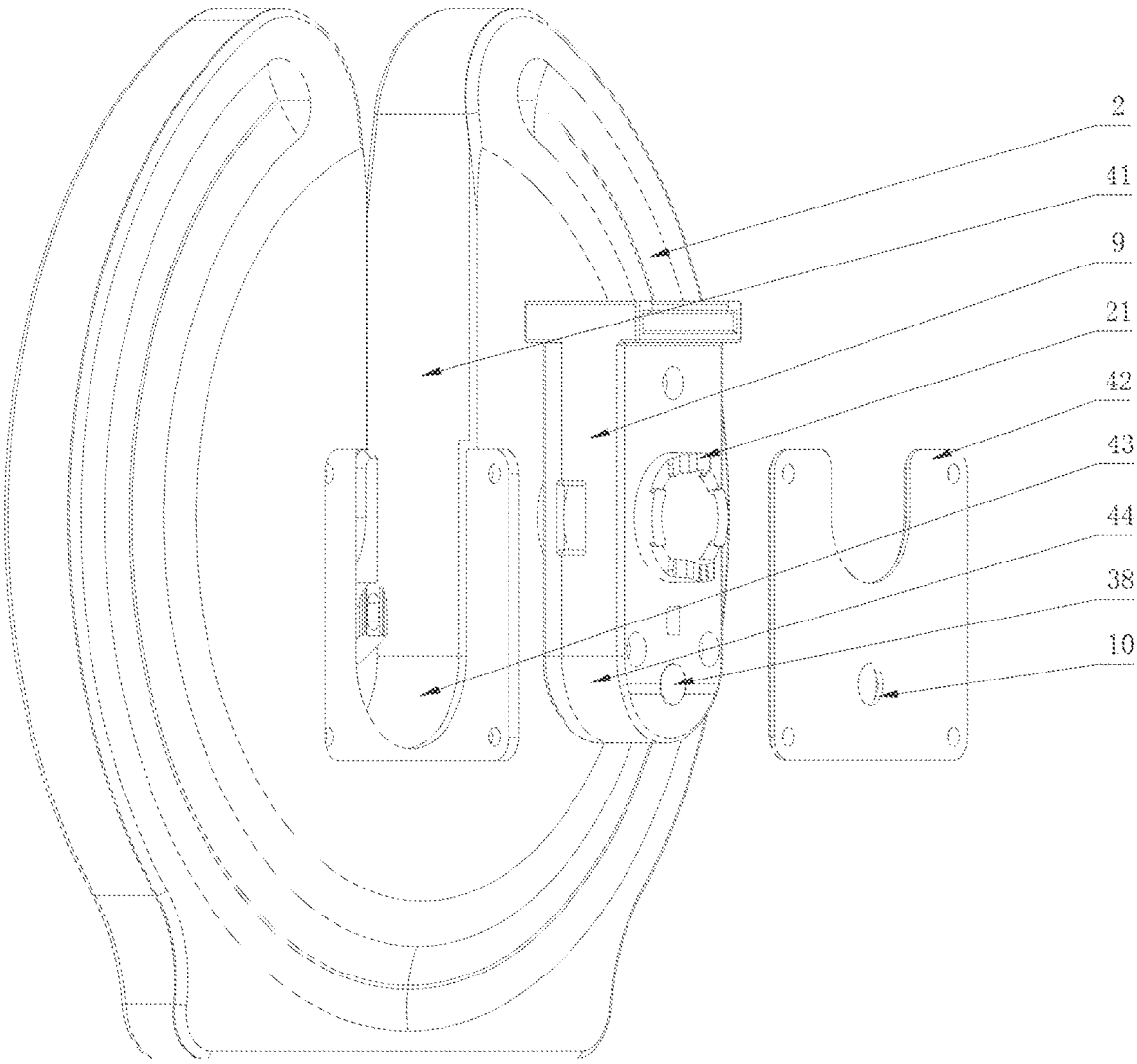
FIG. 7 is an exploded diagram of cooperating the weight adjustment assembly with weight plates according to the invention.
Figure 8:
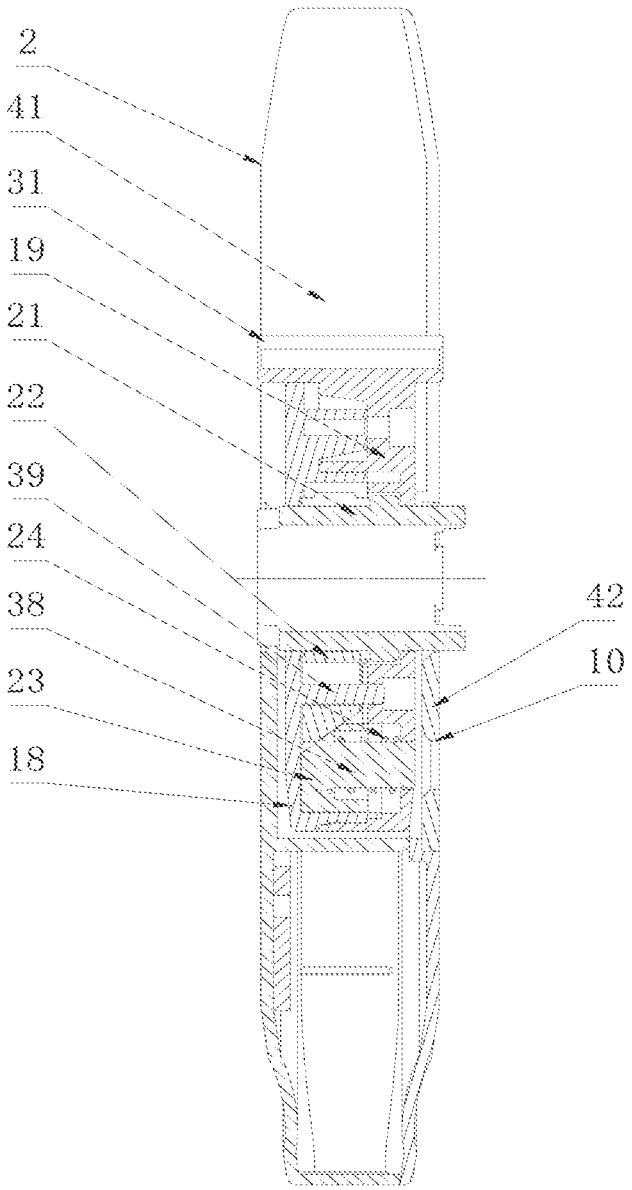
FIG. 8 is a cooperation diagram of separating the weight adjustment assembly from the weight plates according to the invention.
Figure 9:
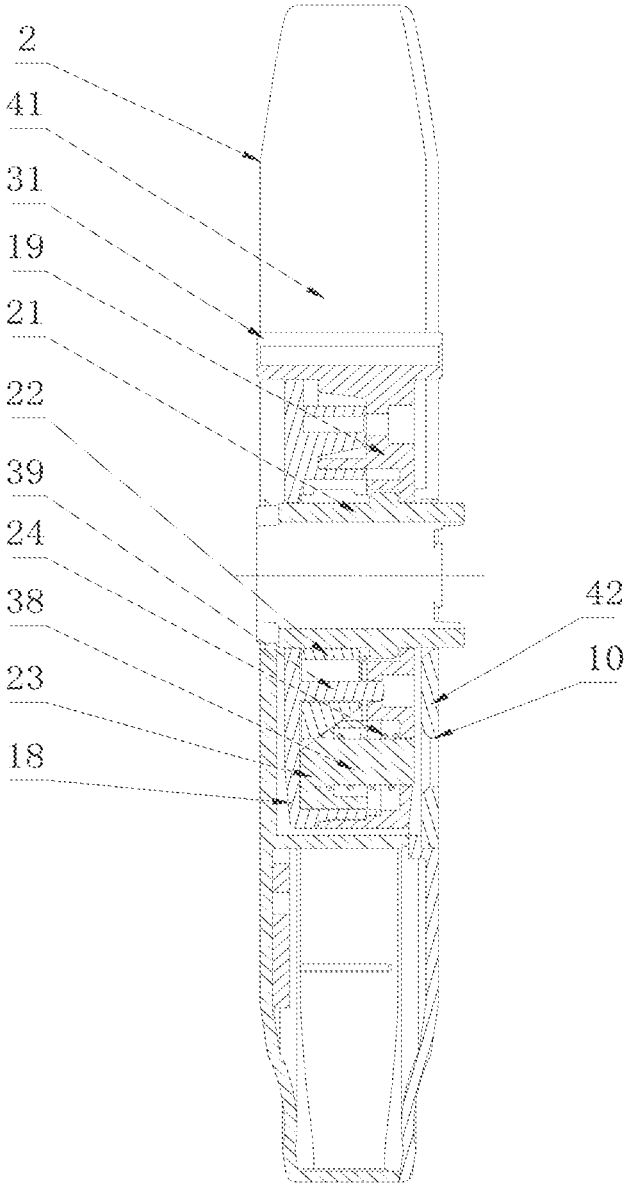
FIG. 9 is a cooperation diagram of combining the weight adjustment assembly with the weight plates according to the invention.

As shown in FIG. 7, the weight plate 2 is provided with an open groove 41, a lower portion of the open groove 41 is provided with a concave inserting groove 43, and both sides of the concave inserting groove 43 are provided with cover plates 42; a lower portion of the weight adjustment assembly 9 is provided with an inserting portion 44 cooperated with the concave inserting groove 43, both sides of the cam 21 are disposed on a semicircular groove of the corresponding cover plate 42, and the cover plate 42 on one side or both sides is provided with weight plate connecting holes 10 cooperated with the column pins 38. When the inserting portion 44 on the lower portion of the weight adjustment assembly 9 is inserted into the concave inserting groove 43 of the weight plate 2, not only the weight plate 2 may be prevented from shaking, but also the column pins 38 and the weight plates 2 may be reliably connected with each other to ensure safe use.

Figure 2:
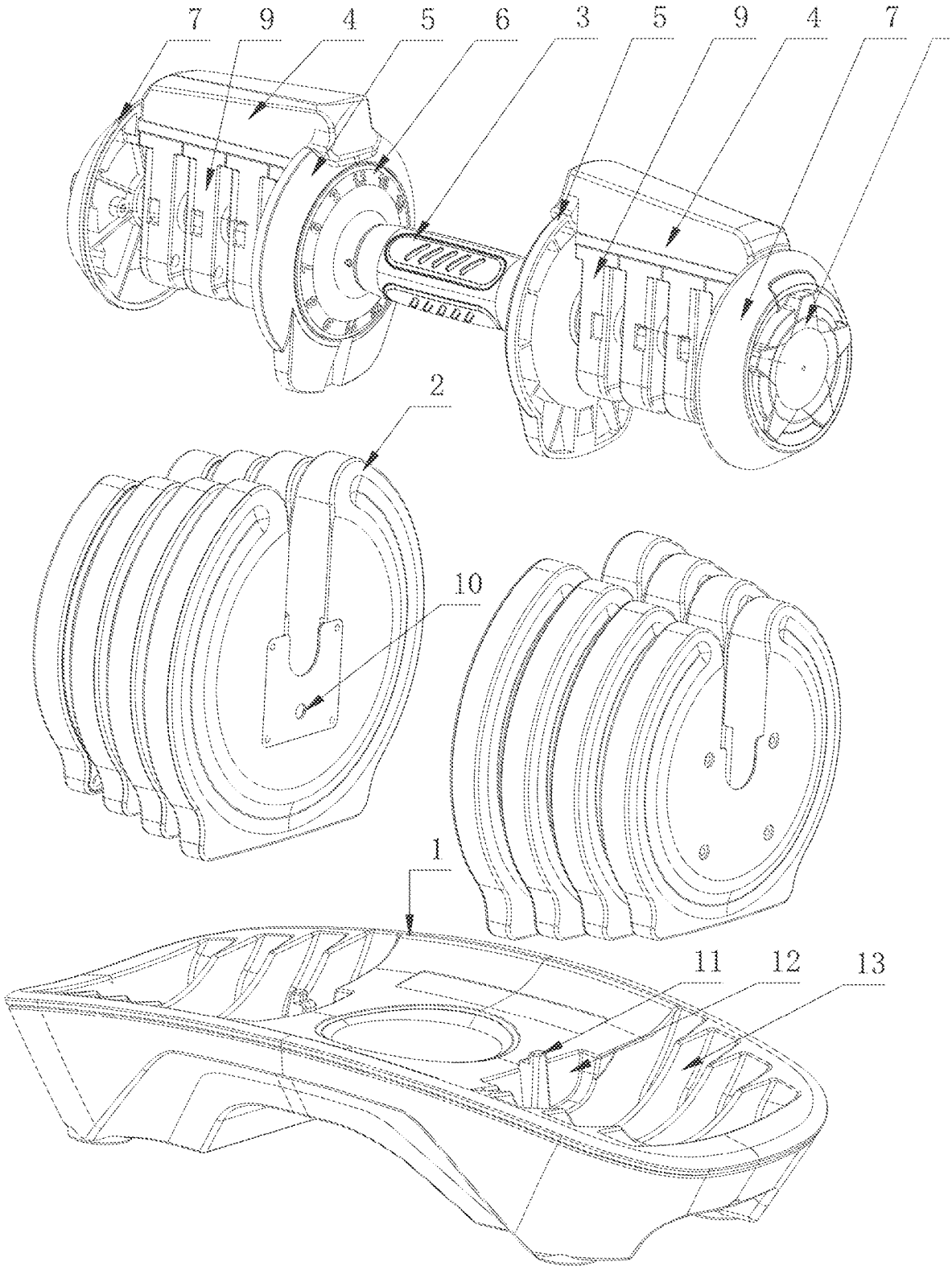
FIG. 2 is an exploded diagram according to the invention.

As shown in FIG. 2, the dumbbell further includes a dumbbell seat 1, the dumbbell seat 1 is provided with a jacking block 11 cooperated with the locking block 25, and the locking mechanism 14 releases the locking of the dial 6 when the jacking block 11 is cooperated with the locking block 25; the dumbbell seat 1 is correspondingly provided with an inner support frame positioning groove 12 for positioning and placing the inner support frame 5, and a weight plate positioning groove 13 for positioning and placing the weight plates 2.

Figure 3:
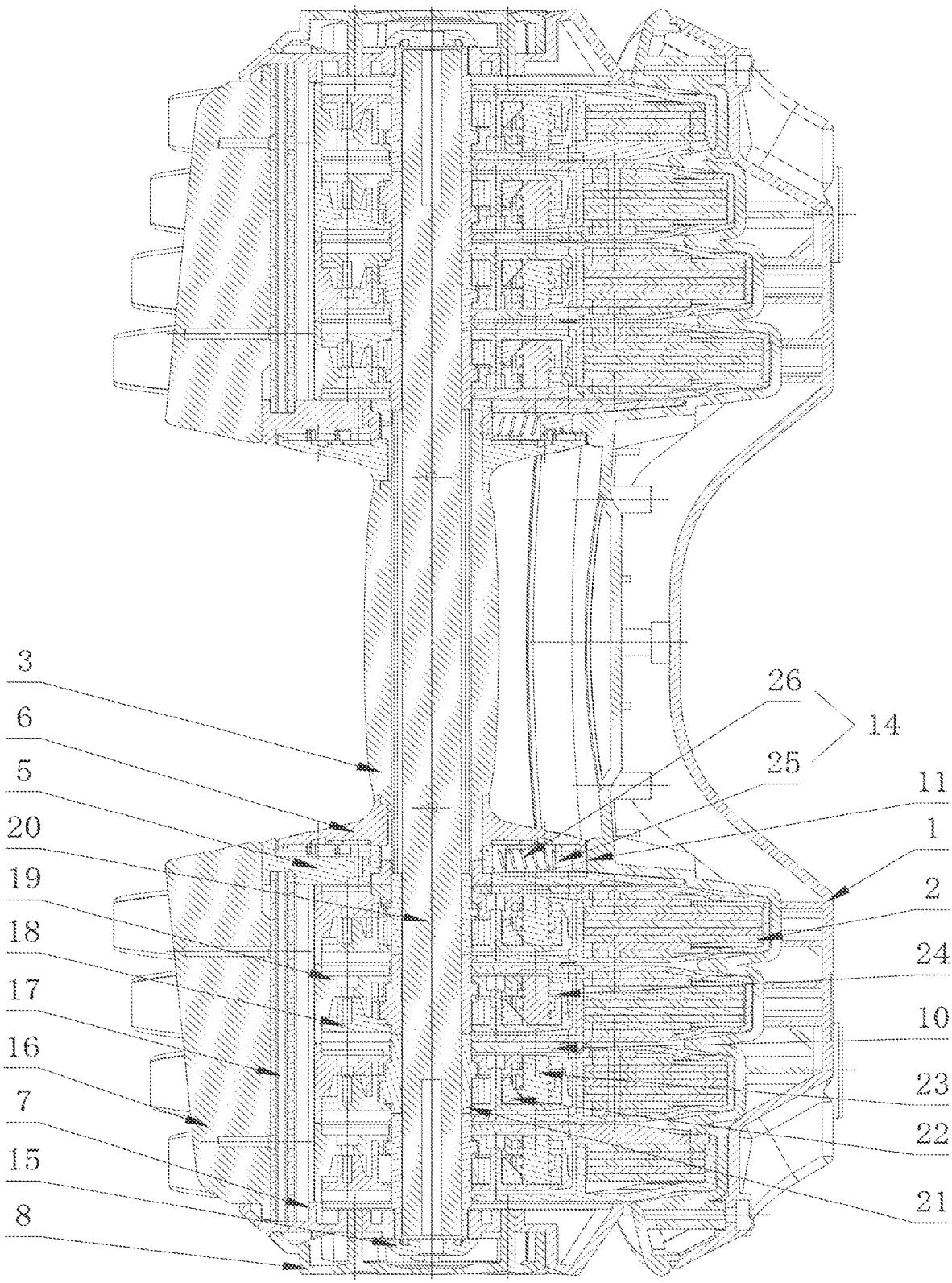
FIG. 3 is a cooperation diagram according to the invention.
Figure 10:
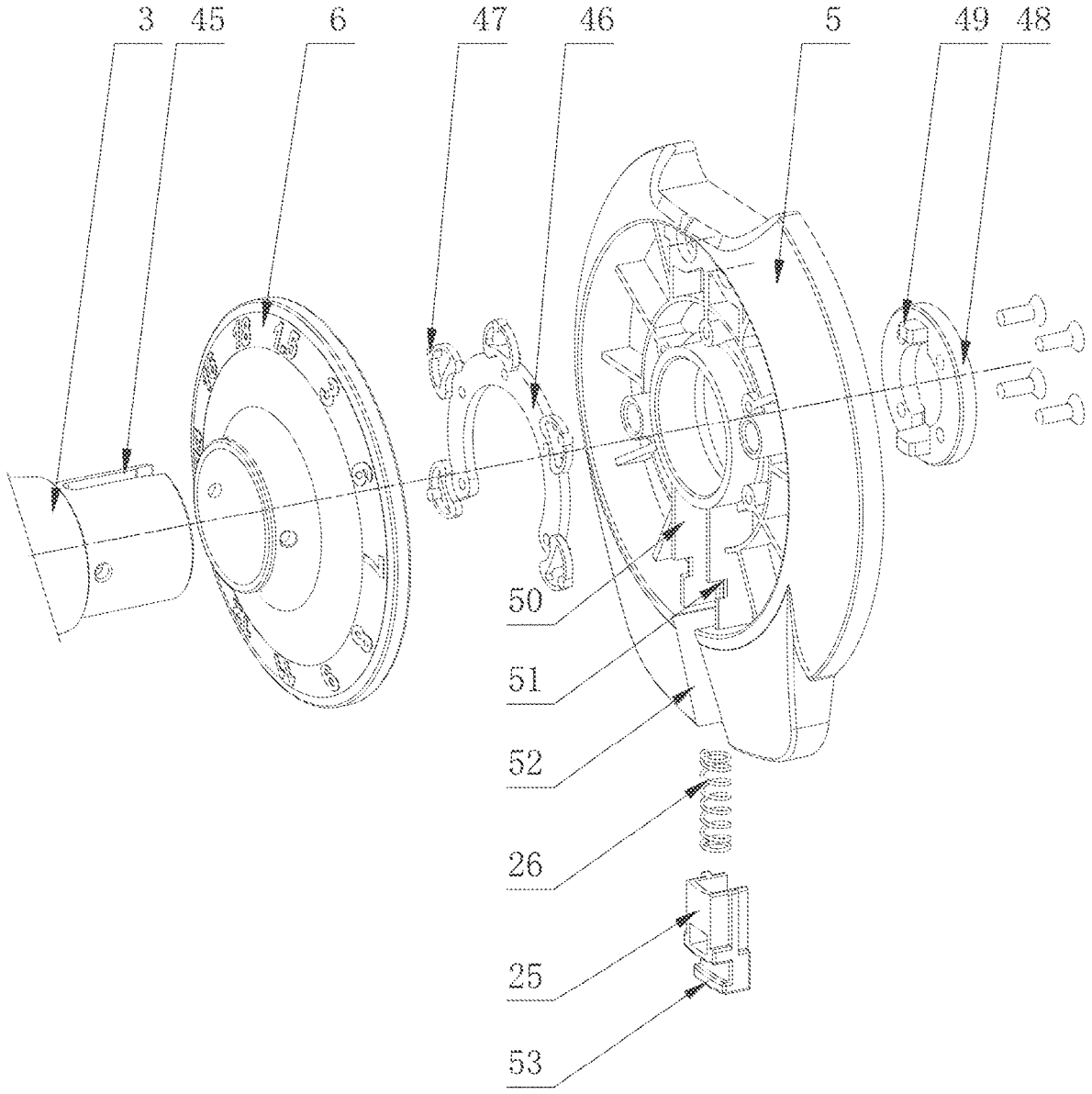
FIG. 10 is an exploded diagram of a locking mechanism according to the invention.
Figure 11:
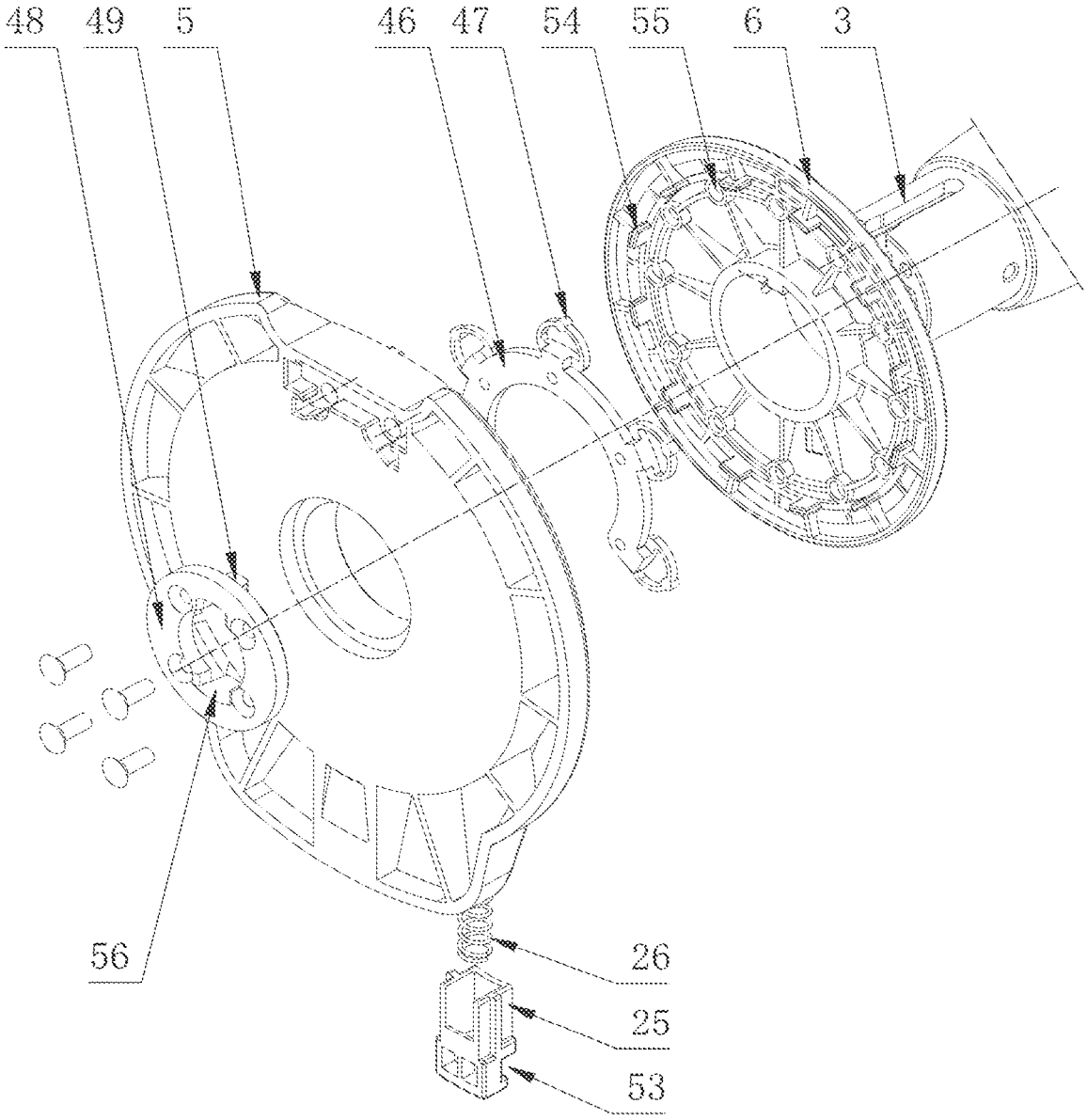
FIG. 11 is an exploded diagram of another direction of the locking mechanism according to the invention.
Figure 12:
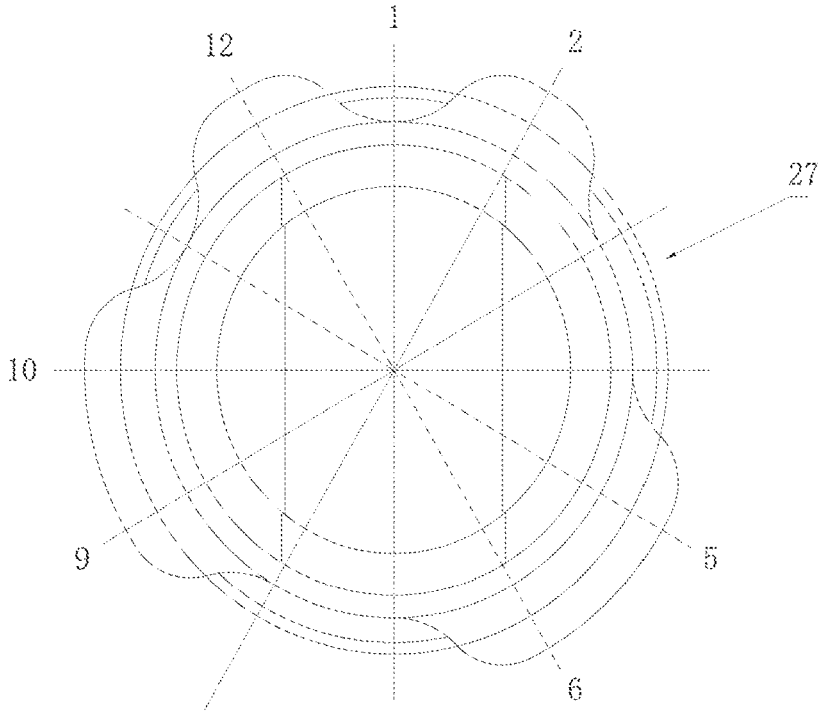
FIG. 12 is a diagram showing the distribution of protruding teeth on a first cam according to the invention.
Figure 13:
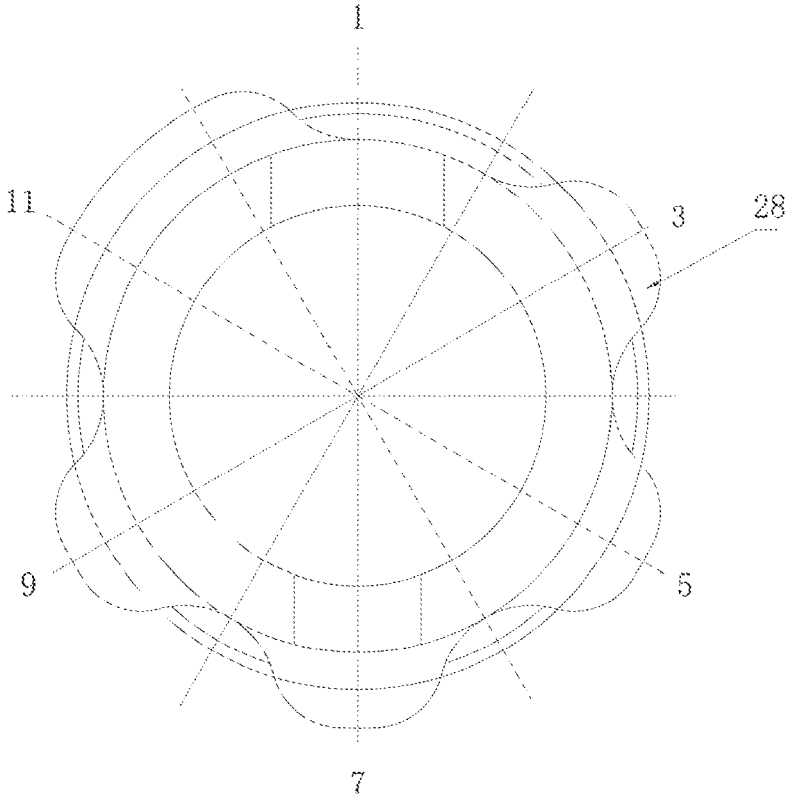
FIG. 13 is a diagram showing the distribution of protruding teeth on a second cam according to the invention.
Figure 14:
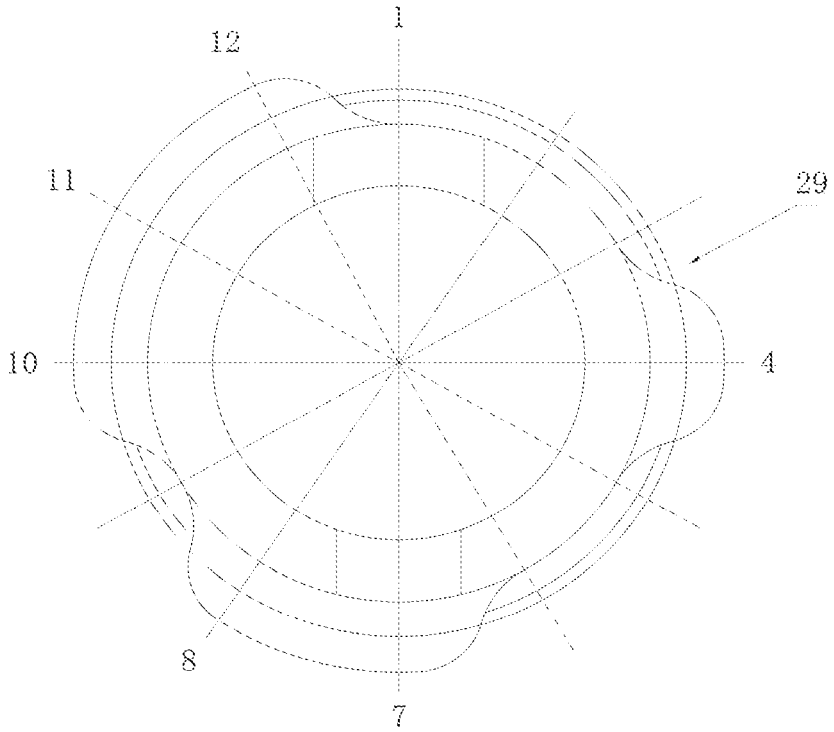
FIG. 14 is a diagram showing the distribution of protruding teeth on a third cam according to the invention.
Figure 15:
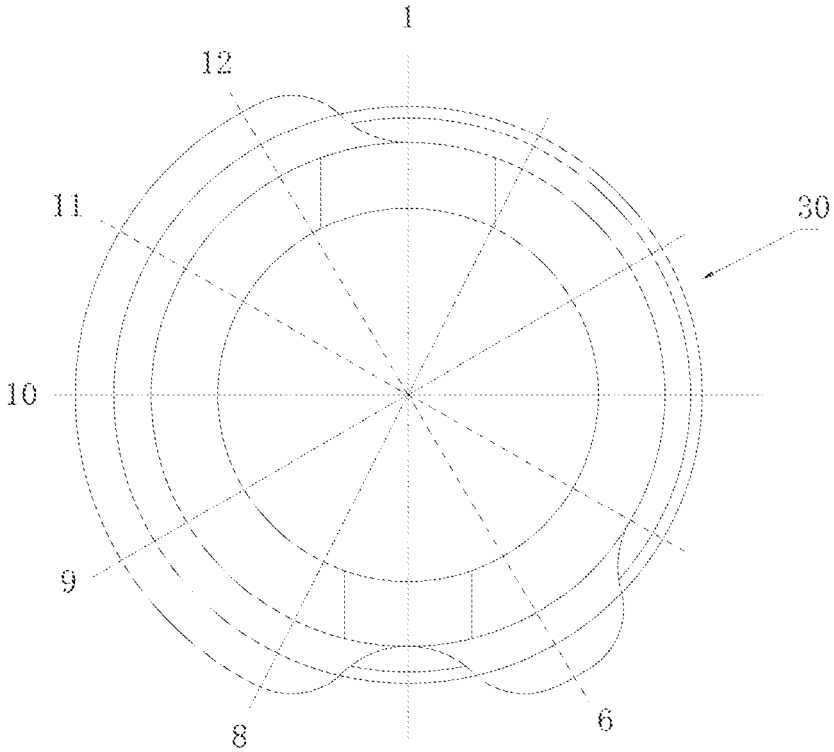
FIG. 15 is a diagram showing the distribution of protruding teeth on a fourth cam according to the invention.

As shown in FIGS. 10 and 11, the locking mechanism 14 includes a spring 26, and a locking block 25; the locking block 25 is provided with a locking block guiding groove 53, and the dial 6 is provided with rotation locking sheets 54 that are evenly distributed around a circumference and correspond to the gear scales; an inner side of the inner support frame 5 is provided with an assembly groove 50 and a jacking block inserting groove 52 connected with the assembly groove 50, and the assembly groove 50 is provided with a rotation guiding groove 51 for the rotation locking sheets 54 to pass through when the dial 6 rotates, the spring 26 and the locking block 25 being mounted on the assembly groove 50 correspondingly; when the dumbbell is placed into the dumbbell seat 1, as shown in FIGS. 1 and 3, the inner support frame 5 is inserted into the inner support frame positioning groove 12 correspondingly, the weight plates 2 are inserted into the weight plate positioning groove 13 correspondingly, the jacking block 11 passes through the jacking block inserting groove 52 to jack the locking block 25 upwardly, and then the locking block guiding groove 53 coincides with the rotation guiding groove 51 for unlocking, followed by rotating handle 3 so that the handle 3 drives the rotation locking sheet 54 on the dial 6 to move smoothly; when the dumbbell is lifted, the jacking block 11 is separated from the locking block 25, the locking block 25 resets under the elastic action of the spring 26, the locking block guiding groove 53 is misplaced with the rotation guiding groove 51, and the locking block 25 blocks the rotation locking sheet 54 to prevent the dial 6 from rotating for locking, so that the weight plates 2 are reliably connected with the weight adjustment assembly 9 to ensure safe use, as shown in FIGS. 10 and 11.

As shown in FIGS. 10 and 11, in order to ensure a clear gear shifting feel when adjusting the weight, the dial 6 is provided with recesses 55 that are evenly distributed around the circumference and correspond to the gear scales, the inner support frame 5 is fixed with a positioning bracket 46, and the positioning bracket 46 is provided with elastic positioning members 47 cooperated with the positioning recesses 55.

The working principle is further described below in conjunction with the embodiment. In the embodiment, four weight plates 2 are provided, and four sets of weight adjustment assemblies 9 corresponding to the weight plates 2 are correspondingly mounted on the connecting frame 17; a first cam 27, a second cam 28, a third cam 29 and a fourth cam 30 are correspondingly mounted on the four sets of weight adjustment assemblies 9 from outside to inside; the dial 6 is provided with twelve gears altogether, which are separated by 30 degrees; the protruding teeth 35 the first cam 27, the second cam 28, the third cam 29 and the fourth cam 30 are distributed as shown in FIGS. 12 to 15.

When the weight is adjusted, first the dumbbell is placed into the dumbbell 1, as shown in FIG. 1, the locking block guiding groove 53 coincides with the rotation guiding groove 51 for unlocking, and then the handle 3 may drive the rotation locking sheet 54 on the dial 6 to pass through the locking block guiding groove 53 and the rotation guiding groove 51 smoothly. Then, the handle 3 is rotated, and the handle 3 can be rotated forward or reversely; the handle 3 drives the dial 6, the dumbbell 20 and the first cam 27, the second cam 28, the third cam 29 and the fourth cam 30 to rotate simultaneously by corresponding gear scales; the protruding teeth 35 on the first cam 27, the second cam 28, the third cam 29 and the fourth cam 30 jack the pushing member 22, the pushing member 22 pushes the sliding member 23 to cause the column pins 38 on the sliding member 23 to move horizontally and to be inserted into the weight plate connecting holes 10 of the corresponding weight plate 2 for weight adjustment.

When the dumbbell is lifted, the jacking block 11 is separated from the locking block 25, the locking block 25 resets under the elastic action of the spring 26, the locking block guiding groove 53 is misplaced from the rotation guiding groove 51, and the locking block 25 blocks the rotation locking sheet 54 to prevent the dial 6 from rotating for locking, so that the weight plates 2 are reliably connected with the weight adjustment assembly 9 during training to ensure safe use while the weight plates 2 that are not selected for hanging remaining on the weight plate positioning groove 13 corresponding to the dumbbell seat 1.

At the first gear, all four cams are not provided with the protruding teeth 35 to form a neutral gear, the weight plate 2 does not hang on the dumbbell rack, and then the weight of the dumbbell is the lightest with only the weight of the dumbbell rack.

At the second gear, the first cam 27 is provided with the protruding teeth 35, the other three cams are not provided with the protruding teeth 35, and the dumbbell rack is hung with the weight plate 2 corresponding to the first cam 27 correspondingly. At the third gear, the second cam 28 is provided with the protruding teeth 35, the other three cams are not provided with the protruding teeth 35, and the dumbbell rack is hung with the weight plate 2 corresponding to the second cam 28 correspondingly.

At the fourth gear, the third cam 29 is provided with the protruding teeth 35, the other three cams are not provided with the protruding teeth 35, and the dumbbell rack is hung with the weight plate 2 corresponding to the third cam 29 correspondingly.

At the fifth gear, the first cam 27 and the second cam 28 are provided with the protruding teeth 35, the other two cams are not provided with the protruding teeth 35, and the dumbbell rack is hung with the weight plates 2 corresponding to the first cam 27 and the second cam 28 correspondingly.

At the sixth gear, the fourth cam 30 is provided with the protruding teeth 35, the other three cams are not provided with the protruding teeth 35, and the dumbbell rack is hung with the weight plate 2 corresponding to the fourth cam 30 correspondingly.

At the seventh gear, the second cam 28 and the third cam 29 are provided with the protruding teeth 35, the other two cams are not provided with the protruding teeth 35, and the dumbbell rack is hung with the weight plates 2 corresponding to the second cam 28 and the third cam 29 correspondingly.

At the eighth gear, the third cam 29 and the fourth cam 30 are provided with the protruding teeth 35, the other two cams are not provided with the protruding teeth 35, and the dumbbell rack is hung with the weight plates 2 corresponding to the third cam 29 and the fourth cam 30 correspondingly.

At the ninth gear, the first cam 27, the second cam 28 and the fourth cam 30 are provided with the protruding teeth 35, the third cam 29 is not provided with the protruding teeth 35, and the dumbbell rack is hung with the weight plates 2 corresponding to the first cam 27, the second cam 28 and the fourth cam 30 correspondingly.

At the tenth gear, the first cam 27, the third cam 29 and the fourth cam 30 are provided with the protruding teeth 35, the second cam 28 is not provided with the protruding teeth 35, and the dumbbell rack is hung with the weight plates 2 corresponding to the first cam 27, the third cam 29 and the fourth cam 30 correspondingly.

At the eleventh gear, the second cam 28, the third cam 29 and the fourth cam 30 are provided with the protruding teeth 35, the first cam 27 is not provided with the protruding teeth 35, and the dumbbell rack is hung with the weight plates 2 corresponding to the second cam 28, the third cam 29 and the fourth cam 30 correspondingly.

At the twelfth gear, all of the first cam 27, the second cam 28, the third cam 29 and the fourth cam 30 are not provided with the protruding teeth 35, and the dumbbell rack is hung with the weight plates 2 corresponding to the first cam 27, the second cam 28, the third cam 29 and the fourth cam 30 correspondingly.

The above descriptions are only specific embodiments of the invention, and are not intended to limit the invention in any form. Any simple modification, equivalent change or modification shall fall within the protection scope of the invention without departing from the technical solution of the invention.

The invention claimed is:

1. An adjustable weight dumbbell, comprising a dumbbell bar, a handle disposed on the dumbbell bar, a dial two dials, each fixedly connected to a respective side of the handle, a two dumbbell rack assemblies, each rotatably disposed on a respective side of the dumbbell bar, a plurality of weight adjustment assemblies, and weight plates cooperated with the weight adjustment assemblies, wherein the dumbbell rack assembly comprises an inner support frame, an outer support frame, and a connecting frame fixedly connected with the inner support frame and the outer support frame, the inner support frame being rotatably cooperated with the handle, the outer support frame being rotatably cooperated with the dumbbell bar, the inner support frame being provided with a locking mechanism for locking a rotation of the inner support frame relative to the dial;

the plurality of weight adjustment assemblies are correspondingly connected on the connecting frame, and each of the plurality of weight adjustment assemblies comprise a weight adjustment housing, a rotatable cam disposed in the weight adjustment housing, and a weight connecting assembly, the rotatable cam being sleeved on the dumbbell bar and provided with protruding teeth arranged in sequence according to the weight, the weight connecting assembly being cooperated with the protruding teeth and driven by the protruding teeth to connect with the corresponding weight plate.

2. The adjustable weight dumbbell according to claim 1, wherein the weight connecting assembly comprises a pushing member that is configured to slide longitudinally relative to the weight adjustment hosing and be cooperated with the protruding teeth, and a sliding member that is configured to slide laterally relative to the weight adjustment housing and may be elastically reset, the sliding member is provided with column pins connected with the weight plates, and the rotatable cams on each of the plurality of weight adjustment assemblies are engaged with each other and then engaged with the handle, when the handle is turned to drive the rotatable cams on each of the plurality of weight adjustment assemblies to rotate, the protruding teeth on different cams of the rotatable cams press the pushing member and the pushing member pushes the sliding member, so that the column pins on the sliding member are connected with different weight plate of the weight plates to adjust the weight.

3. The adjustable weight dumbbell according to claim 2, wherein said weight plates are provided with an open groove, a lower portion of the open groove is provided with a concave inserting groove, and both sides of the concave inserting groove are provided with cover plates, a lower portion of the weight adjustment assembly is provided with an inserting portion cooperated with the concave inserting groove, both sides of the rotatable cam are disposed on a semicircular groove of the corresponding cover plate, and the cover plate on one side or both sides is provided with weight plate connecting holes cooperated with the column pins.

4. The adjustable weight dumbbell according to claim 3, wherein the dial is provided with positioning recesses that are evenly distributed around the circumference and correspond to the gear scales, the inner support frame is fixed with a positioning bracket, and the positioning bracket is provided with elastic positioning members cooperated with the positioning recesses.

5. The adjustable weight dumbbell according to claim 2, wherein the pushing member is provided with a guiding groove, and a guiding pin passing through the guiding groove is disposed between the weight seat and the weight cover.

6. The adjustable weight dumbbell according to claim 1, wherein the weight adjustment housing comprises a weight seat and a weight cover fixed on the weight seat, rotation position sleeves are correspondingly disposed on the weight seat and the weight cover, both sides of the rotatable cams are provided with sleeves, and the sleeves are rotatably cooperated with the rotation positioning sleeves on the weight seat and the weight cover.

7. The adjustable weight dumbbell according to claim 6, wherein the connecting frame is provided with a sliding rail, the weight seat is provided with a sliding groove, the weight seat is mounted on the connecting frame through the cooperation of the sliding groove and the sliding rail, and the connecting frame is provided with a decorative upper cover connecting each of said two dumbbell rack assemblies.

8. The adjustable weight dumbbell according to claim 1, wherein the dial is provided with gear scales that are evenly distributed for indicating the weight, and positions of the protruding teeth provided by the rotatable cams each of on the plurality of weight adjustment assemblies are consistent with the gear scales.

9. The adjustable weight dumbbell according to claim 1, wherein the locking mechanism comprises a spring, and a locking block, the locking block is provided with a locking block guiding groove and the dial is provided with rotation locking sheets that are evenly distributed around a circumference and correspond to the gear scales, an inner side of the inner support frame is provided with an assembly groove, and the assembly groove is provided with a rotation guiding groove for the rotation locking sheets to pass through when the dial rotates, the spring and the locking block are mounted on the assembly groove correspondingly; when the locking block is lifted upwards, the locking block guiding groove coincides with the rotation guiding groove, and the rotation locking sheets are configured to pass through smoothly; when the locking block is unclamped, the locking block guiding groove and the rotation guiding groove are dislocated from each other, and the locking block blocks the rotation locking sheets to prevent the dial from rotating.

10. The adjustable weight dumbbell according to claim 1, wherein the dumbbell further comprises a dumbbell seat, the dumbbell seat is provided with a jacking block cooperated with the locking block, and the locking mechanism releases the locking of the dial when the jacking block is cooperated with the locking block, the dumbbell seat is correspondingly provided with an inner support frame positioning groove for positioning and placing the inner support frame, and a weight plate positioning groove for positioning and placing the weight plates.

* * * * *